United States Patent [19]

Desmarais

[11] 4,447,681

[45] May 8, 1984

[54] SWITCH KEY ASSEMBLY HAVING IMPROVED SWITCH ACTUATION

[75] Inventor: Mark R. Desmarais, Derry, N.H.

[73] Assignee: AMP Incorporated, Harrisburg, Pa.

[21] Appl. No.: 468,732

[22] Filed: Feb. 22, 1983

[51] Int. Cl.[3] ..... H01H 13/70; H01H 3/00

[52] U.S. Cl. ..... 200/5 A; 200/153 LA; 200/159 B; 200/340

[58] Field of Search ..... 200/5 R, 5 A, 16 A, 200/50 C, 153 L, 153 LA, 159 R, 159 A, 159 B, 340, 292

[56] References Cited

U.S. PATENT DOCUMENTS

| | | | |
|---|---|---|---|
| 1,424,402 | 8/1922 | Hartman | 200/153 |
| 1,762,789 | 6/1930 | Nordholm | 200/153 |
| 2,845,498 | 7/1958 | Gaynor | 200/5 |
| 3,909,564 | 9/1975 | Scheingold et al. | 200/5 A X |
| 3,982,081 | 9/1976 | Demler, Jr. | 200/292 X |
| 4,417,115 | 11/1983 | Desmarais et al. | 200/159 B X |

*Primary Examiner*—J. R. Scott

*Attorney, Agent, or Firm*—F. W. Raring

[57] ABSTRACT

Switch key comprises a frame having a frame column and a plunger guided by the column. A return spring biases the plunger to its extended position. When the plunger is depressed, a switch actuator is moved against switch contacts adjacent to the frame to close the switch. The switch actuator comprises a bell crank pivoted to the frame and having a contact arm which closes the switch and a cam arm. The cam arm is cammed by the plunger to close the switch when the plunger is depressed.

19 Claims, 8 Drawing Figures

52
54
48
28
30
34
92
98
94
86
88
87
96
90
68
99
76
72
70
84
31
2
6
18
16
74

SWITCH KEY ASSEMBLY HAVING IMPROVED SWITCH ACTUATION

FIELD OF THE INVENTION

This invention relates to switch key assemblies of the type having a plunger which, when depressed, close an associated switch. The invention particularly relates to the provision of an improved actuator which is caused to close the switch contacts when the plunger of the switch assembly is depressed.

BACKGROUND OF THE INVENTION

A commonly used type of switch key assembly comprises a frame having a frame column and a plunger slideably mounted on the frame. A biasing or return spring is provided which maintains the plunger in its normal or extended position and which is compressed when the column is momentarily depressed. An actuator is provided which is effective, when the plunger is depressed, to bring about closure of the switch which is associated with the switch key assembly.

It is common practice to use a relatively small diameter coil spring directly beneath the plunger as an actuator. When the plunger is depressed, the coil spring is depressed and moves against parts of the switch which are beneath the coil spring to bring about closing of the switch. The switch contacts may be provided on the opposite surfaces of flexible membranes so that compression of the contact spring causes flexure of one of the membrane towards the other membrane.

The present invention is directed to the achievement of an improved actuator which replaces the coil spring type switch actuator that is commonly used. While coil spring type actuators are satisfactory in many respects, they do have some disadvantages. For example, the springs are manufactured as loose piece items which can become tangled with each other in the assembly process when they are assembled to the frame and the plunger. Furthermore, when the plunger is depressed, the actuator spring has the undesirable effect of increasing the resistance of the plunger to an inordinate extent as the plunger approaches and reaches its fully depressed position. In other words, the contact spring contributes materially and significantly to the degree of force required to depress the plunger particularly at the end of the stroke of the plunger. It would be preferrable if the actuator did not contribute to the force requirements so that the assembly could be designed with more precision and could be designed such that it would have an ideal force travel curve. The amount of force required to depress a plunger is a significant factor in the ease and convenience of operating the key switch.

A switch key assembly in accordance with the invention is of the type comprising a frame having a frame column which has a fixed lower end and a free upper end. A plunger is provided on the frame, the plunger being normally in an extended position and being movable on the column parallel to the axis thereof towards the fixed end of the column to a depressed position. A spring is provided to bias the plunger to the extended position. Normally open switch contacts are disposed proximate to the fixed end of the column, and a switch actuator is provided which is responsive to movement of the plunger and which moves the switch contacts to their closed positions when the plunger is moved to the depressed position. The switch key assembly is characterized in that the switch actuator comprises a bell crank having an actuator arm and a cam follower arm. The bell crank is pivotally mounted on a pivotal axis which is proximate to the fixed end of the column and which extends transversely of the axis of the column. The cam follower arm extends beside the axis of the column and the actuator arm extends transversely of the axis of the column. The actuator arm has an actuator portion which is adjacent to the switch contacts and which is movable towards the switch contacts and closes the switch contacts upon rotary movement of the bell crank in a first direction. The cam follower arm has a first cam follower portion and the plunger has a first cam surface thereon which cooperates with the first cam follower portion to cam the bell crank in the first direction upon movement of the plunger to the depressed position whereby upon movement of the plunger from the extended position to the depressed position, the switch contacts are closed, and upon return of the plunger to the extended position, the bell crank rotates in a second direction, which is opposite to the first direction, and the switch contacts are opened.

In accordance with a further embodiment, the column has an axially extending opening extending therein from the free end towards the fixed end and the plunger is slidably contained in the opening. The plunger has an upper end and a lower end, the lower end being proximate to the fixed end of the column, the upper end being beyond the free end of the column when the plunger is in the extended position. The first cam surface extends from the upper end of the plunger. In accordance with a further embodiment, the upper end of the plunger has a force-receiving extension which extends laterally beyond the free end of the column and the first cam surface extends from the extension.

In accordance with a further embodiment, the assembly has an integral supporting base, the fixed end of the column being integral with the supporting base, and the bell crank being pivotally mounted on the supporting base. The cam follower arm has an end portion which is remote from the pivotal axis and the first cam follower portion is on the end portion. In accordance with a further embodiment, the cam follower arm has a second cam follower portion and the plunger has a second cam surface, the second cam follower portion being between the first cam follower portion and the pivotal axis of the bell crank, the second cam surface and the second cam follower portion being effective, during movement of the plunger from the depressed position to the extended position, to rotate the bell crank in the second direction.

DESCRIPTION OF THE PREFERRED EMBODIMENTS

Figure 1:
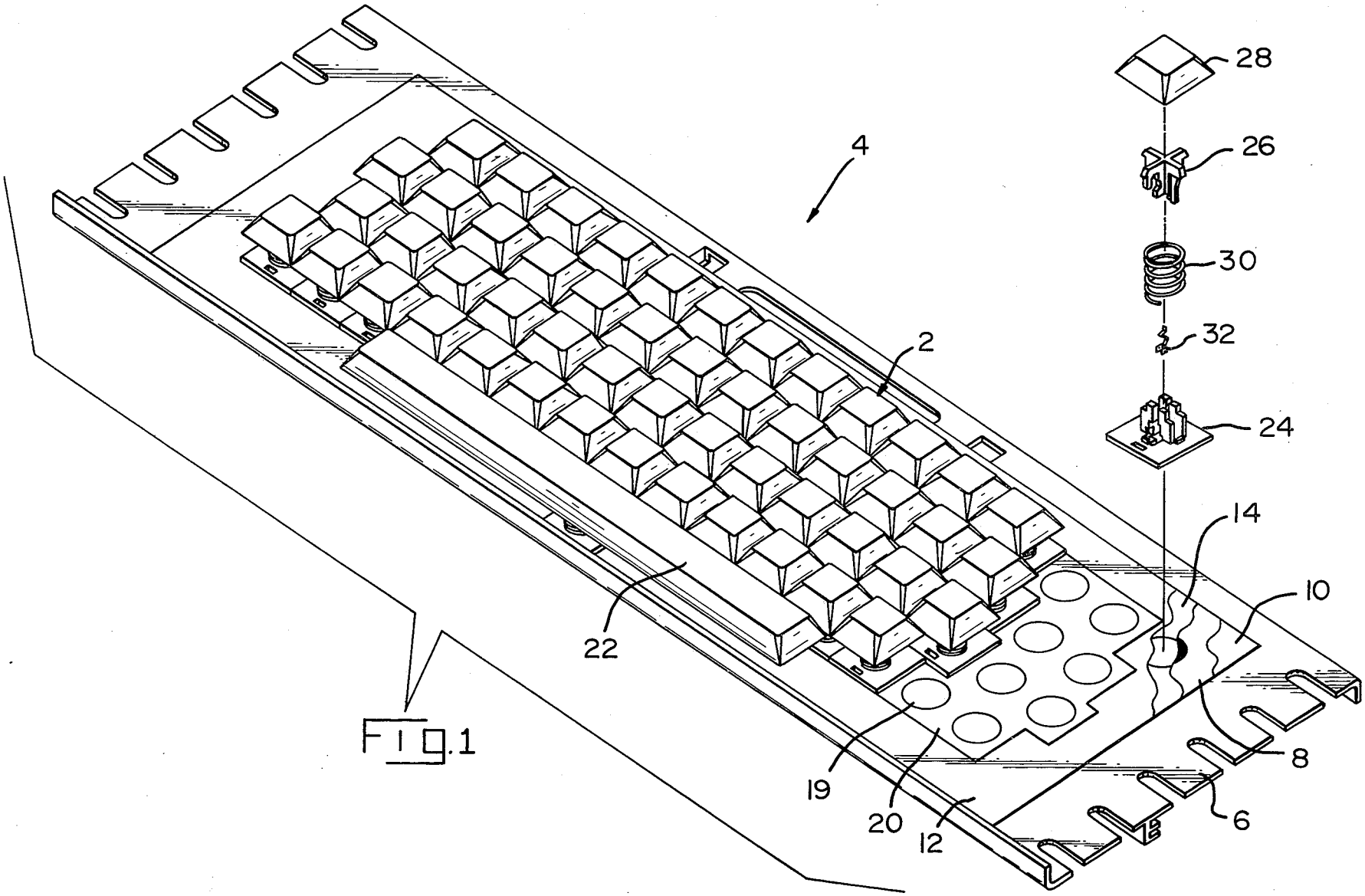
FIG. 1 is a perspective view of a keyboard with parts broken away and showing a key switch assembly exploded from a switch site on the assembly.

FIG. 1 shows a keyboard 4 having a plurality of switch key assemblies 2 mounted thereon at each of a plurality of switch sites 19. The keyboard 4 comprises a rigid supporting panel 6, a circuit substrate 8, and an upper membrane 12. The circuit substrate 8 is bonded to the panel 6 by adhesive 10 and adhesive 14 is provided between the substrate 8 and the upper membrane 12. The adhesive 14 may also function as a spacer between the membrane and the substrate. The opposed surfaces of the membrane and the substrate have switch contacts thereon as shown at 16 and 18, FIG. 3, at each of the switch sites 19. An individual switch key assembly 2 is mounted above each of the switch sites 19 by adhesive 20 on the upper surface of the membrane 12. When any one of the keys is depressed, the contacts 16, 18 are engaged with each other thereby to close the switch at the switch site. A conventional spacer bar 22 is provided at the bottom of keyboard above an additional switch site.

Figure 2:
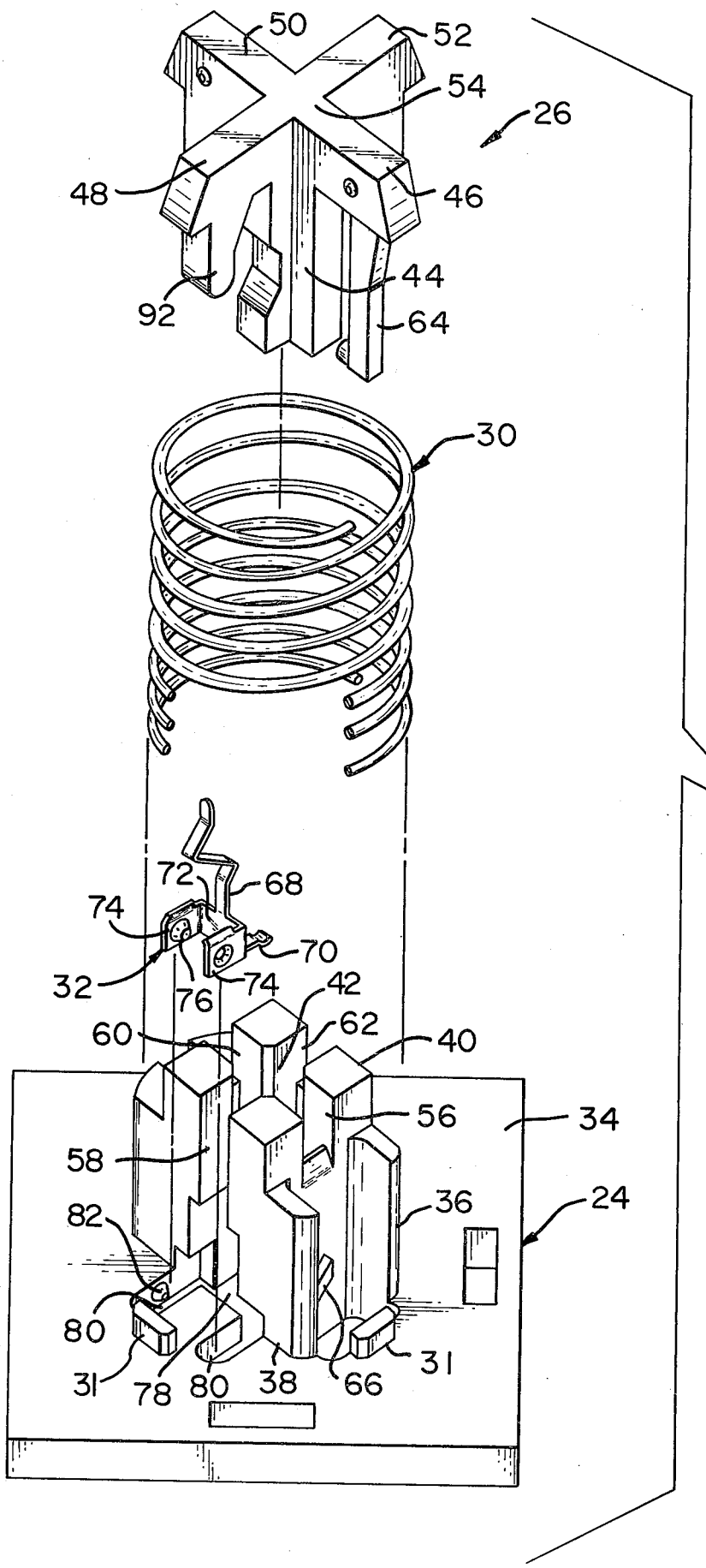
FIG. 2 is a perspective exploded view showing the parts (excepting the key top) of a switch key assembly in accordance with the invention.
Figure 3:
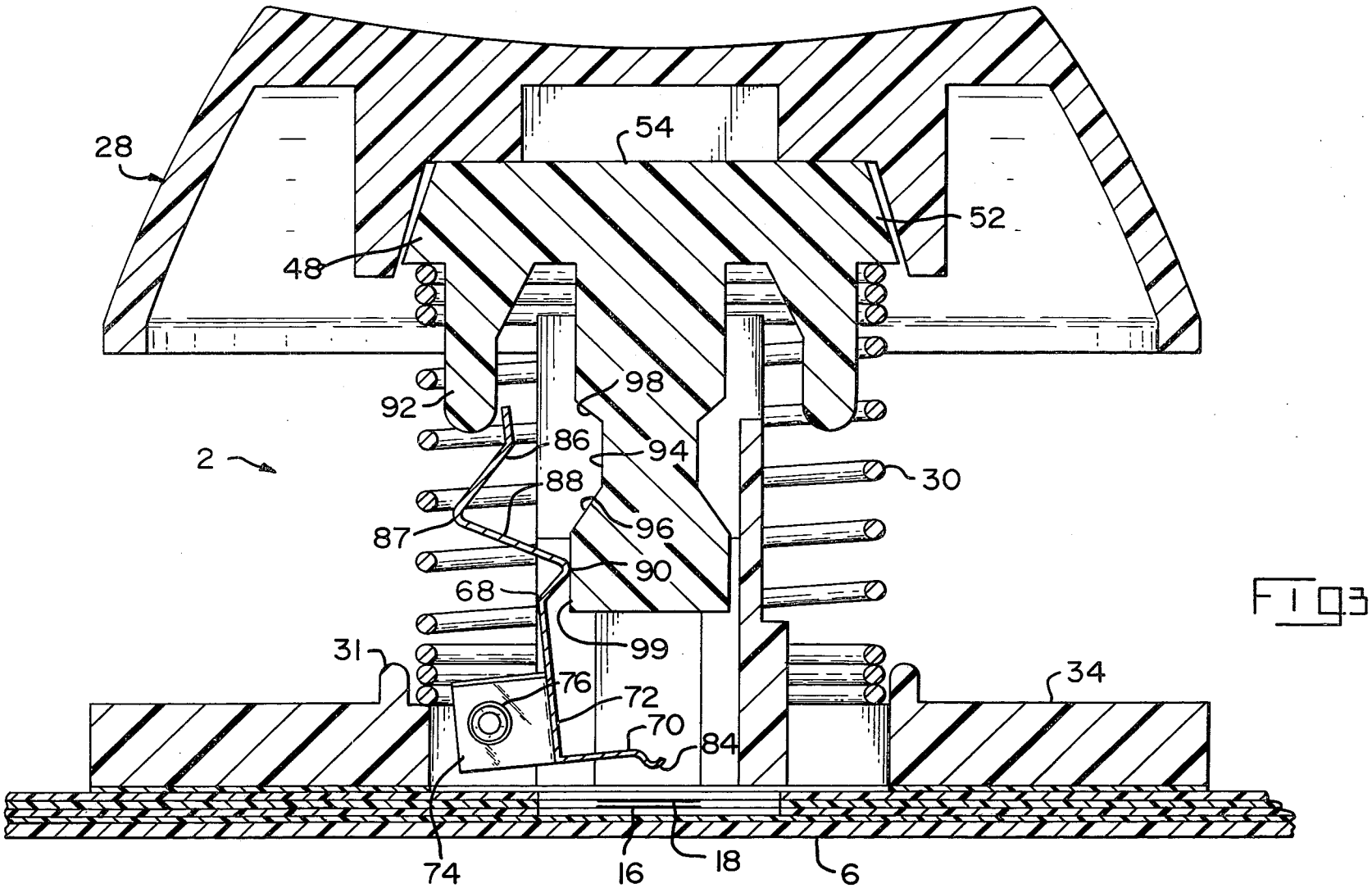
FIG. 3 is a cross-sectional view of a switch key assembly showing the positions of the parts when the plunger is in its normal or extended position.

Referring now to FIGS. 2 and 3, each switch key assembly 2 comprises a frame 24, a plunger 26, a key top 28, a biasing spring or return spring 30, and a switch actuator 32. The frame and the plunger may be of molded insulating material and are assembled to each other along with the return spring and the actuator as shown in FIG. 2.

The frame 24 comprises a regtangular base 34 having a column 36 extending from its upper surface. The column has a lower or fixed end 38, a free upper end 40, and has an axial opening 34 extending therethrough. An opening 78 is provided in the base 34 beneath the column opening 42 as described below.

The plunger 26 has a shaft portion 44 which is received in opening 42 and has an upper or force receiving end 54 on which the key top 28 is mounted. At its upper end 54, the plunger has radially extending arms 46, 48, 50 and 52. When the plunger is depressed, the arm 46 is received in a slot 56 in the column, the arm 48 is received in the upper portion of an axial opening 58 in the column, the arm 50 is received in a slot 60, and the arm 52 is received in a slot 62. The arm 46 has a depending camming arm 64 integral therewith which is engageable with a cam 66 on the surface of the column to provide a tactile effect when the plunger is depressed by finger pressure on the key top. This feature is explained fully in application Ser. No. 354,318 filed Mar. 3, 1982.

As shown in FIG. 3, when the parts are assembled, the return spring 30 is in surrounding relationship to the column 36 and bears against the downwardly facing surfaces of the arms 46–52, this spring being retained by suitable retaining bosses 31 on the upper surface of the frame base 34. The actuator 32 is also surrounded by the return spring and mounted in the base as will now be described.

The actuator 32 comprises a bell crank having a cam follower arm 68 and an actuator arm 70. Both of these arms extend from a web section 72 and parallel ears 74 extend from the web section in a direction opposite to that of the contact arm 70. The ears 74 have inwardly formed bosses 76 which in turn provide generally conical depressions on the external surfaces of the ears. These ears 74 are received in slots 80 which extend from the opening 78 in the base and the side surfaces of these slots have bosses 82 that are dimensioned to enter the depressions in the ears. The actuator is thus pivotally mounted on an axis that extends normally of the axis of the plunger and which is beside the column 36.

The actuator arm 70 has a contact end portion 84 which is curved downwardly as viewed in FIG. 3 and which is above the switch contacts 16, 18 when the parts are in the position of FIG. 3. This actuator arm extends through the side opening 58 in the column adjacent to the base of the column while the camming arm 68 is received in the opening.

The camming arm has an upper end portion 86 which extends generally diagonally towards the axis of the plunger and which is beneath a first cam 92 that depends from the arm 48 of the plunger. The portion 86 of the camming arm is a first cam follower and is engaged by the cam 92 as shown in FIGS. 4–6 when the plunger is depressed to cause the bell crank actuator to be swung through a slight clockwise arc.

The upper end portion 86 of the cam arm is connected by a reverse bend 87 to an intermediate inwardly directed portion 88 which in turn extends to a second reverse bend 90 that serves as a second cam follower on the camming arm. The reverse bend portion 90 is against the side surface of the shaft portion 34 and this side surface has a recess 94 therein which is spaced from the lower end of the plunger. Recess 94 merges with a lower inclined surface portion 96 and an upper inclined surface portion 98, both of these portions extending to surface portions 99 and 101 respectively on the side of the plunger.

It will be apparent from a study of FIG. 3 that the surface 99 will maintain the bell crank actuator in the position of FIG. 3 so long as the plunger remains in its normal or extended position. As a result, the end portion 84 of the arm 70 is held away from the upper surface of the membrane 12 and a positive means is thereby provided to insure that the switch contacts will not be accidentally closed.

Figure 4:
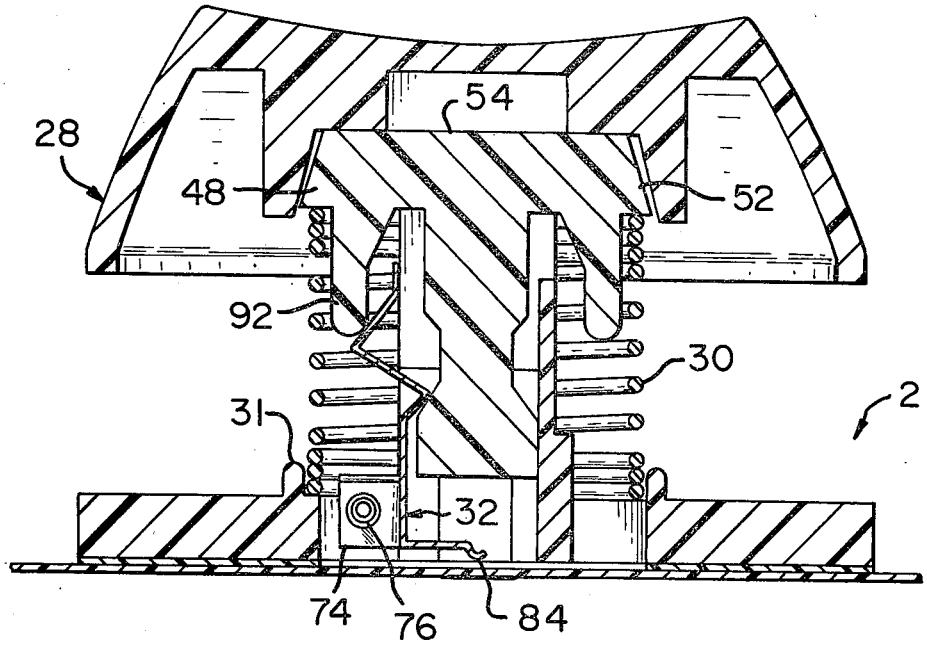
FIGS. 4, 5, and 6 are views similar to FIG. 3 showing the movements of the parts when the plunger is moved to its fully depressed position.
Figure 5:
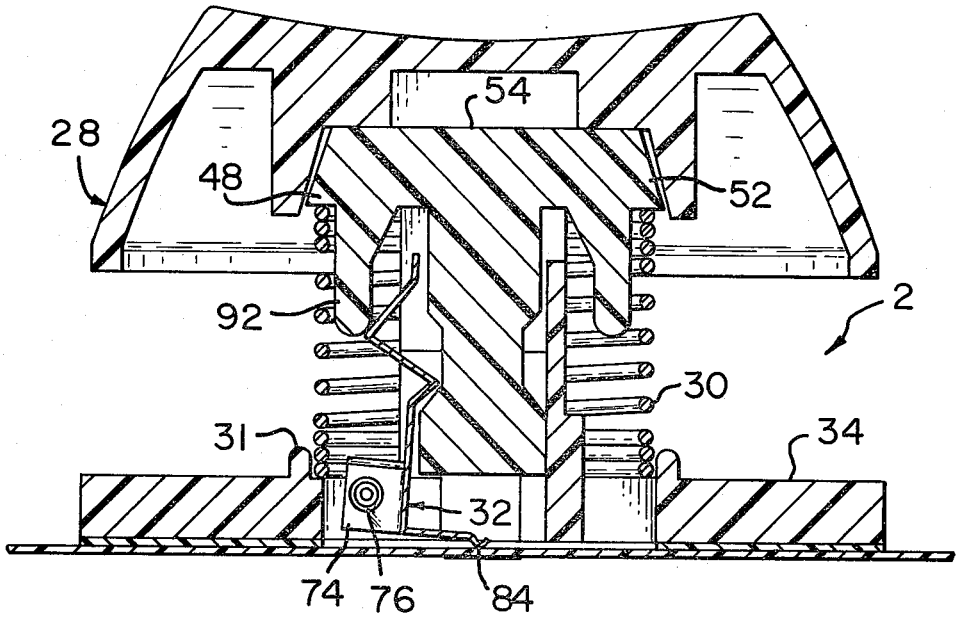
Figure 6:
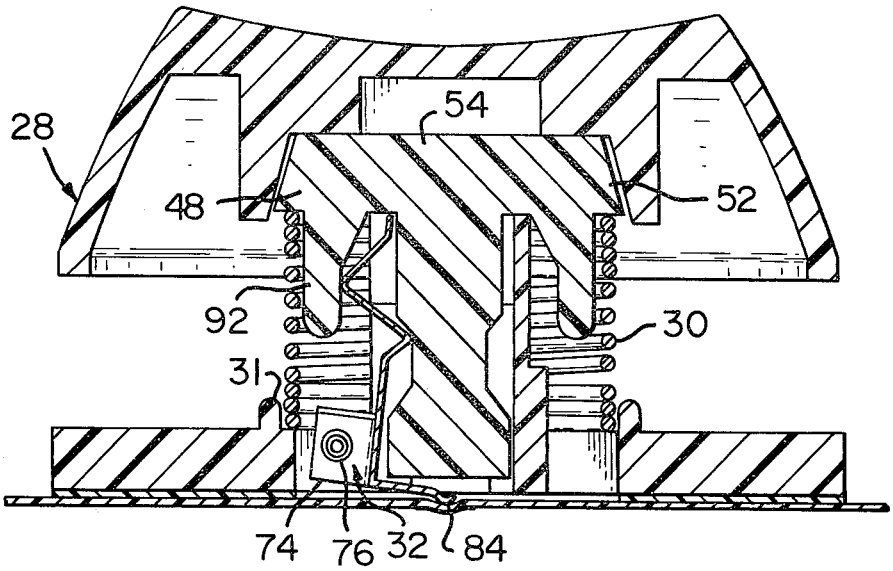

When the plunger is depressed as shown in FIGS. 4–6, the lower end of the cam 92 engages the free end portion 86 of the camming arm to cause clockwise rotation of the bell crank from the position of FIG. 3. Also during depression of the plunger, the surface 96 moves past the reverse bend 90 of the camming arm 68 so that such clockwise movement is permitted. As the plunger is further depressed, FIGS. 5 and 6, the reverse bend 90 will move in engagement with the surface 94 of the plunger and the upper reverse bend 80 will move along the surface of the cam 92.

When the plunger returns to its normal position from the position of FIG. 6 under the influence of the return spring 30, the parts move respectively from the position of FIG. 6 to the position of FIGS. 5, 4, and 3. During such upward movement of the plunger, the bell crank is cammed in a counterclockwise direction by camming surface 96 and cam follower 90 and the contact arm is thereby lifted from the upper surface of the membrane to allow the switch contacts to open.

Figure 7:
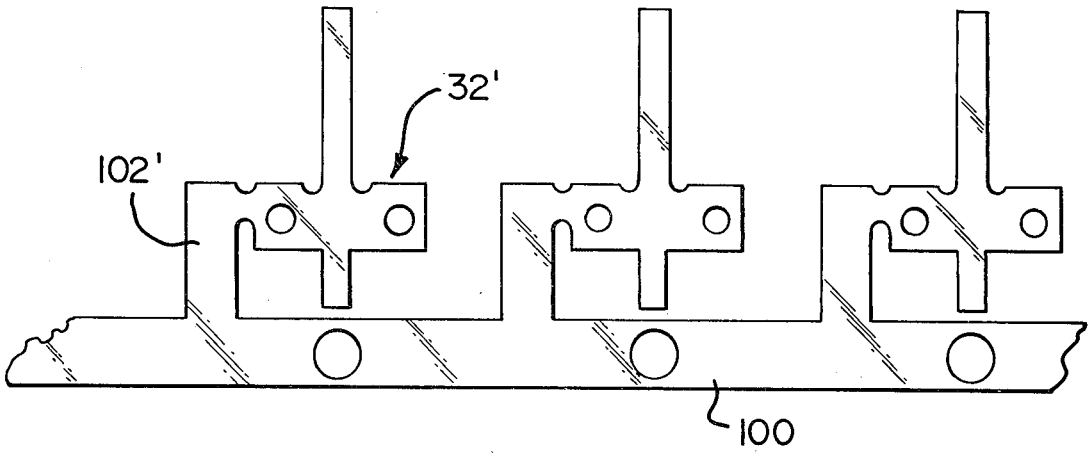
FIG. 7 is a plan view of a short section of sheet metal blanks which are later formed into switch actuators.
Figure 8:
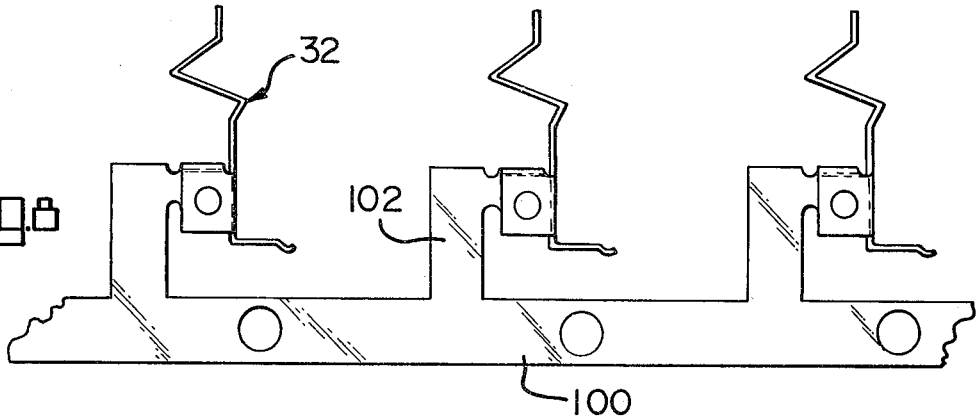
FIG. 8 is a view similar to FIG. 7 showing a switch actuator as formed by sheet metal stamping and forming operations.

FIGS. 7 and 8 show the manner in which the actuator members 32 can be manufactured in continuous strip form. The individual actuator blanks 32′ are stamped from sheet metal with each blank being connected to the carrier strip 100 by connecting sections 102. The blanks 32′ are formed into the bell crank actuators as shown in FIG. 8 while still part of the carrier strip and the actuators can thus be removed from the strip and assembled to switch frames by suitable automatic assembly machines.

As noted above, the contact arm 70 of the bell crank actuator is lifted in a positive manner when the plunger is moved by the return spring from its depressed position to its normal position. This is a desirable feature in that it insures that the actuator will be moved away from the switch contacts thereby allowing the contacts to open. It is also desirable in that the end 84 of the actuator arm can be bonded or otherwise secured to the membrane 12 so that counterclockwise movement of the bell crank will bring about positive opening of the switch when the plunger moves upwardly from its depressed position. If the actuator arm is secured to the membrane 12, it would be necessary to make slight changes in the position of the arm from the position shown in FIG. 3.

I claim:

1. A switch key assembly of the type comprising a frame having a frame column, the column having a fixed lower end and a free upper end, a plunger on the frame, the plunger being normally in an extended position and being movable on the column parallel to the axis thereof towards the fixed end of the column to a depressed position, a spring which is effective to bias the plunger to the extended position, normally open switch contacts disposed proximate to the fixed end of the column, and a switch actuator which is responsive to movement of the plunger for moving the switch contacts to their closed positions when the plunger is moved to the depressed position, the switch key assembly being characterized in that:

the switch actuator comprises a bell crank having an actuator arm and a cam follower arm, the bell crank being pivotally mounted on a pivotal axis which is proximate to the fixed end of the column and which extends transversely of the axis of the column, the cam follower arm extending beside the axis of the column and the actuator arm extending transversely of the axis of the column, the actuator arm having an actuator portion which is adjacent to the switch contacts and which is movable towards the switch contacts and which closes the switch contacts upon rotary movement of the bell crank in a first direction, the cam follower arm having a first cam follower portion and the plunger having a first cam surface thereon which cooperates with the first cam follower portion to cam the bell crank in the first direction upon movement of the plunger to the depressed position whereby, upon movement of the plunger from the extended position to the depressed position, the switch contacts are closed, and upon return of the plunger to the extended position, the bell crank rotates in a second direction, which is opposite to the first direction, and the switch contacts are opened.

2. A switch key assembly as set forth in claim 1 characterized in that the column has an axially extending opening extending therein from the free end towards the fixed end, the plunger being slidably contained in the opening.

3. A switch key assembly as set forth in claim 2 characterized in that the plunger has an upper end and a lower end, the lower end being proximate to the fixed end of the column, the upper end being beyond the free end of the colomn when the plunger is in the extended position, the first cam surface extending from the upper end of the plunger.

4. A switch key assembly as set forth in claim 3 characterized in that the upper end of the plunger has a force-receiving extension which extends laterally beyond the free end of the column, the first cam surface extending from the extension.

5. A switch key assembly as set forth in claim 4 characterized in that the switch contacts are disposed beneath, and in alignment with, the plunger, the column having a side opening therein which communicates with the axially extending opening, the actuator arm extending through the side opening.

6. A switch key assembly as set forth in claim 5 characterized in that the side opening comprises a slot in the column which extends from the free end thereof towards the fixed end, portions of the cam follower arm being received in the slot.

7. A switch key assembly as set forth in claim 6 characterized in that the cam follower arm has a second cam follower portion and the plunger has a second cam surface, the second cam surface being effective, during movement of the plunger from the depressed position to the extended position, to engage the second cam follower portion and rotate the bell crank in the second direction.

8. A switch key assembly as set forth in claim 7 characterized in that the assembly has an integral supporting base, the fixed end of the column being integral with the supporting base, the bell crank being pivotally mounted on the supporting base.

9. A switch key assembly as set forth in claim 1 characterized in that the cam follower arm has an end portion which is remote from the pivotal axis, the first cam follower portion being on the end portion.

10. A switch key assembly as set forth in claim 9 characterized in that the cam follower arm has a second cam follower portion and the plunger has a second cam surface, the second cam follower portion being between the first cam follower portion and the pivotal axis of the bell crank, the second cam surface and the second cam follower portion being effective, during movement of the plunger from the depressed position to the extended position, to rotate the bell crank in the second direction.

11. A key switch assembly as set forth in claim 9 characterized in that the plunger has an upper end and a lower end, the lower end being proximate to the fixed end of the column, the upper end being beyond the free end of the column when the plunger is in the extended position, the first cam surface extending from the upper end of the plunger.

12. A switch key assembly as set forth in claim 11 characterized in that the upper end of the plunger has a force-receiving extension which extends laterally beyond the free end of the column, the first cam surface extending from the extension.

13. A switch key assembly as set forth in claim 1 characterized in that the column has an axially extending opening extending therein from the free end towards the fixed end, the plunger being slidably contained in the opening, the switch contacts being beneath, and in alignment with, the plunger, the column having a side opening therein which communicates with the axially extending opening, the actuator arm extending through the side opening.

14. A switch key assembly as set forth in claim 13 characterized in that the side opening comprises a slot in the column which extends from the free end thereof towards the fixed end, portions of the cam follower arm being received in the slot.

15. A switch key assembly as set forth in claim 1 characterized in that the first cam surface and the first cam follower portion are effective to rotate the bell crank to the limit of its travel in the first direction prior to arrival of the plunger at the depressed position and to maintain the bell crank at the limit of its travel in the first direction until the plunger travels to the depressed position and partially returns to the extended position.

16. A switch key assembly as set forth in claim 15 characterized in that the first cam surface has an actuating portion and a holding portion, the actuating portion being initially engageable with the first cam follower portion during movement of the plunger to the depressed position and being effective to rotate the bell crank to the limit of its travel in the first direction, the holding portion being engageable with the first cam follower portion during the final portion of the stroke of the plunger to the depressed position and during the initial portion of the return stroke of the plunger to the extended position.

17. A switch key assembly as set forth in claim 16 characterized in that the switch contacts are disposed beneath, and in alignment with, the plunger, the column having a side opening therein which communicates with the axially extending opening, the actuator arm extending through the side opening, the plunger having an upper end and a lower end, the lower end being proximate to the fixed end of the column, the upper end being beyond the free end of the column when the plunger is in the extended position, the first cam surface extending from the upper end of the plunger.

18. A switch key assembly as set forth in claim 17 characterized in that the upper end of the plunger has a force-receiving extension which extends laterally beyond the free end of the column, the first cam surface extending from the extension.

19. A switch key assembly as set forth in claim 18 characterized in that the force-receiving extension has a depending arm, the first cam surface being on the depending arm, the actuating portion of the first cam surface extending transversely of the axis of the plunger and the holding portion extending parallel to the axis of the plunger.

* * * * *